US006238118B1

(12) United States Patent
Tryon

(10) Patent No.: US 6,238,118 B1
(45) Date of Patent: May 29, 2001

(54) TOOTHBRUSH WITH TOOTHPASTE FEED SYSTEM

(76) Inventor: Traci L. Tryon, 393 Saguaro Dr., Louisville, KY (US) 40229

( * ) Notice: Subject to any disclaimer, the term of this patent is extended or adjusted under 35 U.S.C. 154(b) by 0 days.

(21) Appl. No.: 09/626,828

(22) Filed: Jul. 27, 2000

(51) Int. Cl.[7] ..... B43K 5/04

(52) U.S. Cl. ..... 401/153; 401/132; 401/176; 401/270; 401/282

(58) Field of Search ..... 401/153, 132, 401/152, 155, 270, 282, 171, 176, 177, 179

(56) References Cited

U.S. PATENT DOCUMENTS

| | | | | |
|---|---|---|---|---|
| 3,261,367 | * | 7/1966 | Pickering | 401/153 |
| 4,717,278 | * | 1/1988 | Kemeny | 401/132 |
| 5,154,523 | * | 10/1992 | Devreeze | 401/144 |
| 5,476,333 | * | 12/1995 | Matthews | 401/132 |
| 5,842,487 | | 12/1998 | Ledet | 132/308 |
| 5,882,134 | | 3/1999 | Hatch | 401/281 |
| 5,908,257 | | 6/1999 | Martin | 401/271 |
| 5,909,977 | * | 6/1999 | Kuo | 401/146 |
| 5,913,632 | | 6/1999 | Persad | 401/175 |
| 5,915,868 | * | 6/1999 | Frazell | 401/132 |
| 5,918,996 | | 7/1999 | Coolbaugh | 401/175 |

* cited by examiner

*Primary Examiner*—David J. Walczak
(74) *Attorney, Agent, or Firm*—Joseph N. Breaux

(57) ABSTRACT

A toothbrush with a toothpaste feed system that includes a toothpaste cartridge feed handle, a hollow brush head, a resilient hinge openable neck structure connected between the toothpaste cartridge feed handle and the hollow brush head and providing a neck toothpaste passageway between a toothpaste feed end of a toothpaste cartridge cavity within toothpaste cartridge feed handle and a brush head toothpaste passageway formed within hollow brush head, and an accordion fold toothpaste filled cartridge with a rupturable perforated foil end that is sized to fit into the toothpaste cartridge cavity with the rupturable perforated foil end positioned within toothpaste feed end of toothpaste cartridge cavity. The back of the hollow brush head is provided with a flip open back cap that is in connection with the brush head toothpaste passageway and which is moveable into an open position to allow for cleaning of the brush head toothpaste passageway between uses.

1 Claim, 3 Drawing Sheets

TOOTHBRUSH WITH TOOTHPASTE FEED SYSTEM

TECHNICAL FIELD

The present invention relates to toothbrushes with toothpaste delivery systems and more particularly to a toothbrush with toothpaste feed system that includes a toothpaste cartridge feed handle, a hollow brush head, a resilient hinged neck structure connected between the toothpaste cartridge feed handle and the hollow brush head and providing a neck toothpaste passageway between a toothpaste feed end of a toothpaste cartridge cavity within toothpaste cartridge feed handle and a brush head toothpaste passageway formed within hollow brush head, and an accordion fold toothpaste filled cartridge with a rupturable perforated foil end that is sized to fit into the toothpaste cartridge cavity with the rupturable perforated foil end positioned within toothpaste feed end of toothpaste cartridge cavity; toothpaste cartridge feed handle having a rotatable cap and cartridge compressing slide bar that are movable to allow for insertion of the accordion fold toothpaste filled cartridge into the a toothpaste cartridge cavity through a hinged opening provided between the neck of the brush head and the toothpaste cartridge feed handle; the cartridge compressing slide bar being slidable such that the accordion fold toothpaste filled cartridge is compressed sufficiently to rupture the rupturable foil end and force toothpaste through the neck toothpaste passageway and the brush head toothpaste passageway and out onto the brush bristles through a number of toothpaste dispensing openings formed through the exterior of the hollow brush head and positioned adjacent to the bristle bottoms of the brush bristles; the hollow brush head further including a flip open back cap that is in connection with the brush head toothpaste passageway and which is moveable into an open position to allow for cleaning of the brush head toothpaste passageway between uses.

BACKGROUND ART

It can often be desirable to have a toothbrush provided with a quantity of toothpaste which is stored in the handle and which is dispensable onto the bristles of the toothbrush from dispensing orifices provided through the brush head and adjacent to the brush bristles as needed. Although such toothbrushes are known, they can become contaminated between uses by mouth fluids that seep into the toothpaste passageways through the dispensing orifices. It would be desirable, therefore, to have toothbrush with toothpaste delivery system that included a back cap on the brush head that could be removed or opened after brushing and which could be washed out so that contamination occurring during brushing can be removed.

GENERAL SUMMARY DISCUSSION OF INVENTION

It is thus an object of the invention to provide a toothbrush with toothpaste feed system that includes a toothpaste cartridge feed handle, a hollow brush head, a resilient hinged neck structure connected between the toothpaste cartridge feed handle and the hollow brush head and providing a neck toothpaste passageway between a toothpaste feed end of a toothpaste cartridge cavity within toothpaste cartridge feed handle and a brush head toothpaste passageway formed within hollow brush head, and an accordion fold toothpaste filled cartridge with a rupturable perforated foil end that is sized to fit into the toothpaste cartridge cavity with the rupturable perforated foil end positioned within toothpaste feed end of toothpaste cartridge cavity; toothpaste cartridge feed handle having a rotatable cap and cartridge compressing slide bar that are movable to allow for insertion of the accordion fold toothpaste filled cartridge into the a toothpaste cartridge cavity through a hinged opening provided between the neck of the brush head and the toothpaste cartridge feed handle; the cartridge compressing slide bar being slidable such that the accordion fold toothpaste filled cartridge is compressed sufficiently to rupture the rupturable foil end and force toothpaste through the neck toothpaste passageway and the brush head toothpaste passageway and out onto the brush bristles through a number of toothpaste dispensing openings formed through the exterior of the hollow brush head and positioned adjacent to the bristle bottoms of the brush bristles; the hollow brush head further including a flip open back cap that is in connection with the brush head toothpaste passageway and which is moveable into an open position to allow for cleaning of the brush head toothpaste passageway between uses.

Accordingly, a toothbrush with toothpaste feed system is provided. The toothbrush with toothpaste feed system includes a toothpaste cartridge feed handle, a hollow brush head, a resilient hinged neck structure connected between the toothpaste cartridge feed handle and the hollow brush head and providing a neck toothpaste passageway between a toothpaste feed end of a toothpaste cartridge cavity within toothpaste cartridge feed handle and a brush head toothpaste passageway formed within hollow brush head, and an accordion fold toothpaste filled cartridge with a rupturable perforated foil end that is sized to fit into the toothpaste cartridge cavity with the rupturable perforated foil end positioned within toothpaste feed end of toothpaste cartridge cavity; toothpaste cartridge feed handle having a rotatable cap and cartridge compressing slide bar that are movable to allow for insertion of the accordion fold toothpaste filled cartridge into the a toothpaste cartridge cavity through a hinged opening provided between the neck of the brush head and the toothpaste cartridge feed handle; the cartridge compressing slide bar being slidable such that the accordion fold toothpaste filled cartridge is compressed sufficiently to rupture the rupturable foil end and force toothpaste through the neck toothpaste passageway and the brush head toothpaste passageway and out onto the brush bristles through a number of toothpaste dispensing openings formed through the exterior of the hollow brush head and positioned adjacent to the bristle bottoms of the brush bristles; the hollow brush head further including a flip open back cap that is in connection with the brush head toothpaste passageway and which is moveable into an open position to allow for cleaning of the brush head toothpaste passageway between uses.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
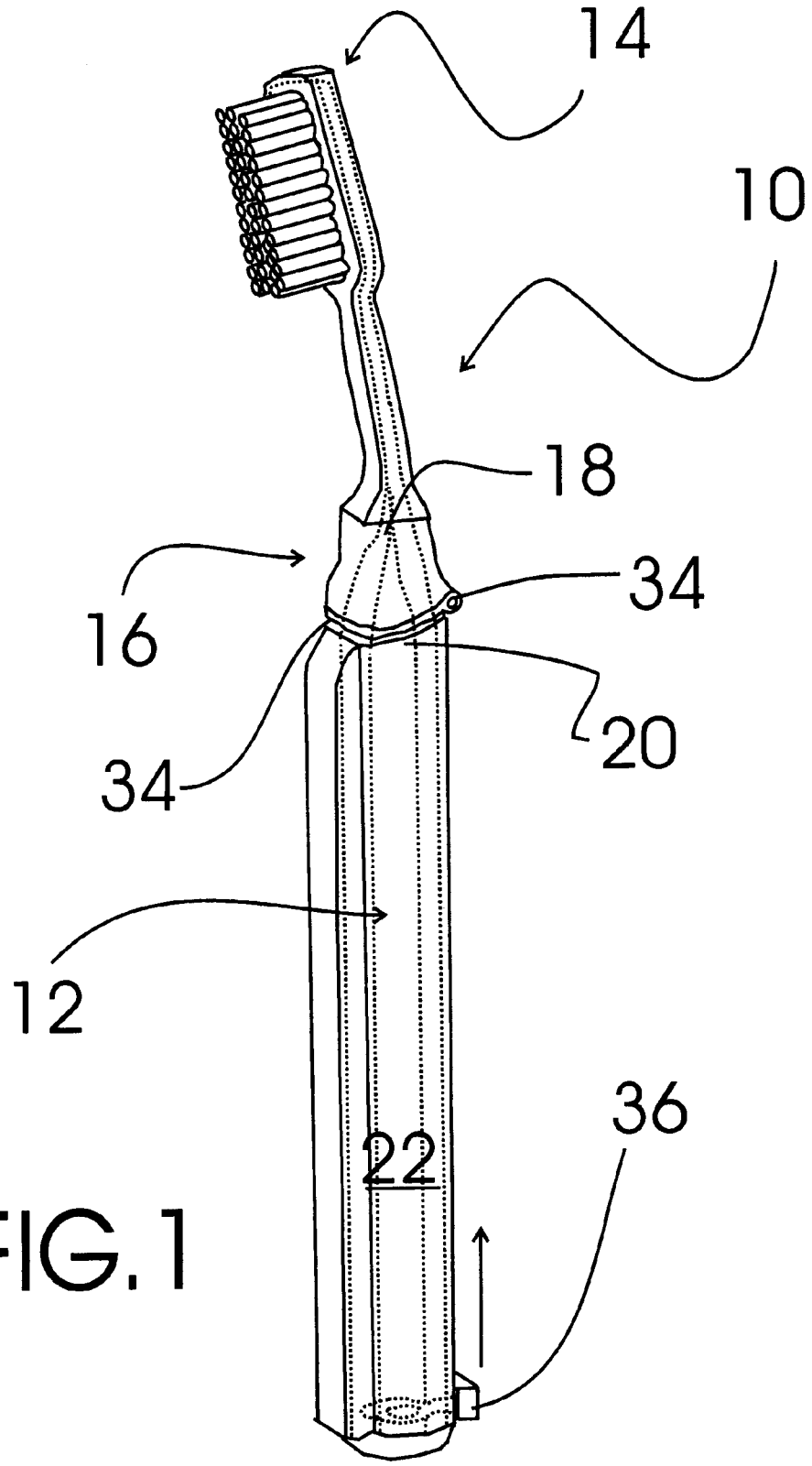
FIG. 1 is a perspective view of an exemplary embodiment of the toothbrush with toothpaste feed system of the present invention.
Figure 4:
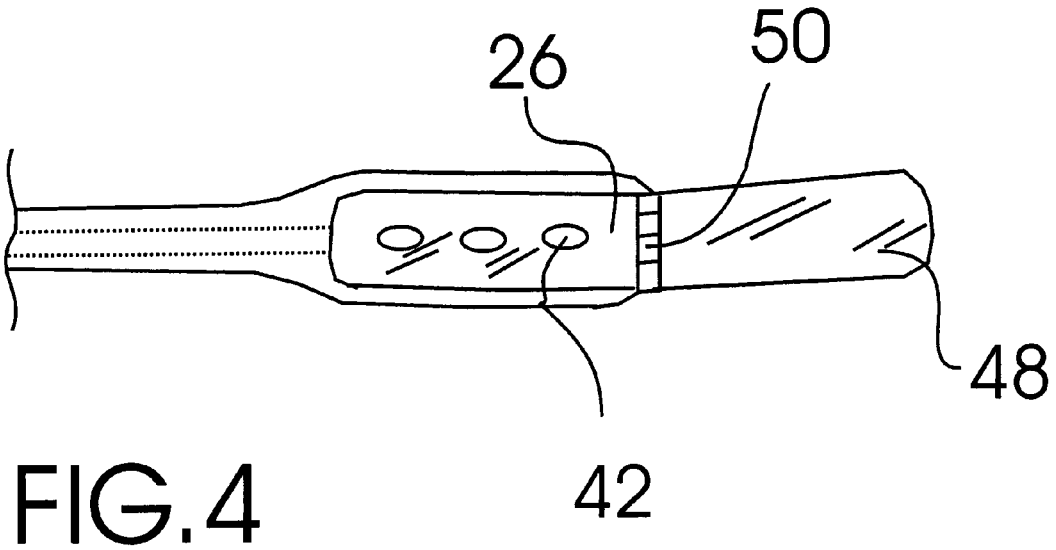
FIG. 4 is a back plan detail view of the hollow brush head with the flip open back cap in the open position to allow for cleaning of the brush head toothpaste passageway between uses and to reveal the three toothpaste dispensing openings positioned adjacent to the bristle bottoms of the brush bristles.
Figure 2:
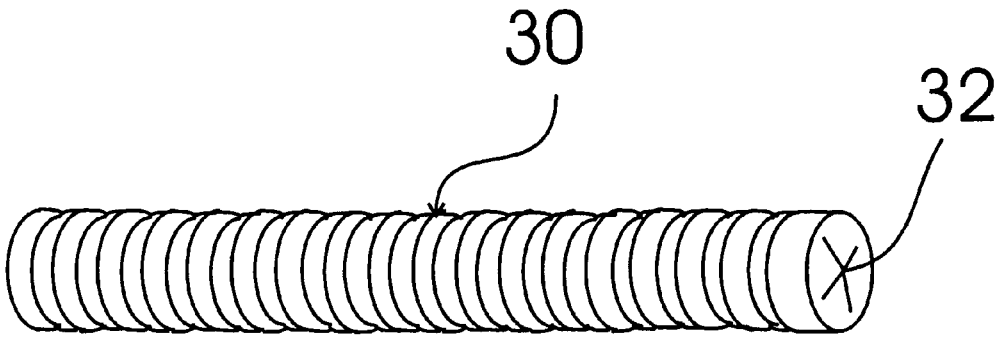
FIG. 2 is a perspective view of the accordion fold toothpaste filled cartridge with rupturable perforated foil end of the toothbrush with toothpaste feed system of FIG. 1.
Figure 3:
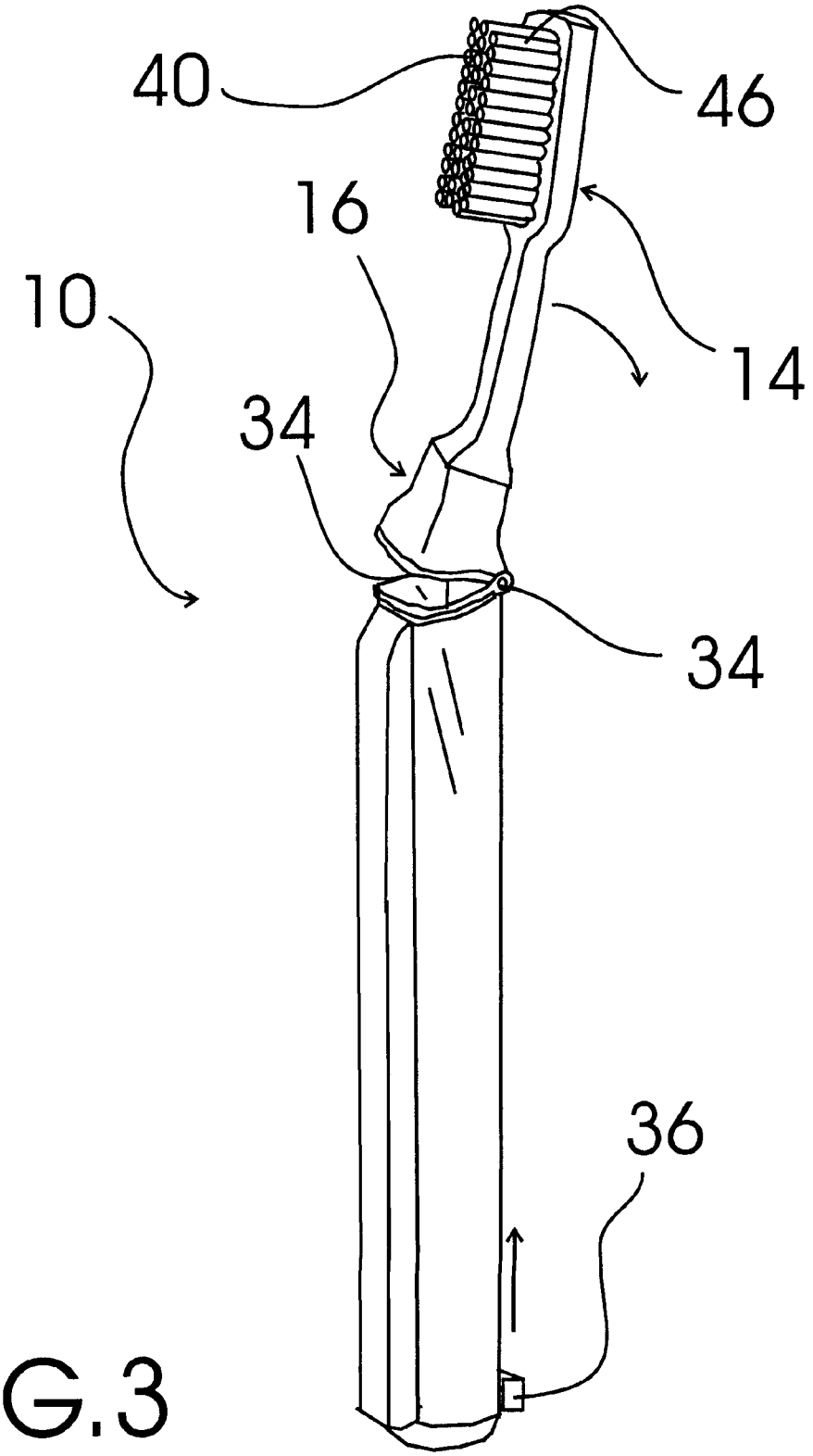
FIG. 3 is a side perspective view of the toothbrush with toothpaste feed system of FIG. 1 showing the resilient hinge openable neck structure between the toothpaste cartridge feed handle and the hollow brush head with flip open back cap.

FIGS. 1–4 show various aspects of an exemplary embodiment of the toothbrush with toothpaste feed system of the present invention, generally designated 10. Toothbrush with toothpaste feed system 10 includes a toothpaste cartridge feed handle, generally designated 12; a hollow brush head, generally designated 14; a resilient hinged neck structure, generally designated 16, connected between toothpaste cartridge feed handle 12 and hollow brush head 14 and providing a neck toothpaste passageway 18 between a toothpaste feed end 20 of a toothpaste cartridge cavity 22 within toothpaste cartridge feed handle 12 and a brush head toothpaste passageway 26 formed within hollow brush head 14; and an accordion fold toothpaste filled cartridge, generally designated 30, with a rupturable perforated foil end 32 that is sized to fit into toothpaste cartridge cavity 22 with rupturable perforated foil end 32 positioned within toothpaste feed end 20 of toothpaste cartridge cavity 22.

Toothpaste cartridge feed handle 12 is connected to brush head 14 by a hinged neck opening structure 34 to allow for insertion of the accordion fold toothpaste filled cartridge 30 into toothpaste cartridge cavity 22. Cartridge compressing slide bar 36 is slidable such that the accordion fold toothpaste filled cartridge 30 is compressed sufficiently to rupture the rupturable foil end 32 and force toothpaste through the neck toothpaste passageway 18 and the brush head toothpaste passageway 26 and out onto the brush bristles 40 through three toothpaste dispensing openings 42 formed through the exterior of hollow brush head 14 and positioned adjacent to the bristle bottoms 46 of the brush bristles 40.

Hollow brush head 14 also includes a flip open back cap 48 that is connected by a hinge 50 and which provides access to brush head toothpaste passageway 26 when in an open position to allow for cleaning of the brush head toothpaste passageway 26 between uses.

It can be seen from the preceding description that a toothbrush with toothpaste feed system has been provided.

It is noted that the embodiment of the toothbrush with toothpaste feed system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A toothbrush with toothpaste feed system comprising:

a toothpaste cartridge feed handle;

a hollow brush head;

a resilient hinged neck structure connected between the toothpaste cartridge feed handle and the hollow brush head and providing a neck toothpaste passageway between a toothpaste feed end of a toothpaste cartridge cavity within the toothpaste cartridge feed handle and a brush head toothpaste passageway formed within the hollow brush head; and an accordion fold toothpaste filled cartridge with a rupturable perforated foil end that is sized to fit into the toothpaste cartridge cavity with the rupturable perforated foil end positioned within the toothpaste feed end of the toothpaste cartridge cavity;

the resilient hinged neck structure providing an insertion opening to allow for insertion of the accordion fold toothpaste filled cartridge;

a cartridge compressing slide bar being slidable such that the accordion fold toothpaste filled cartridge is compressed sufficiently to rupture the rupturable foil end and force toothpaste through the neck toothpaste passageway and the brush head toothpaste passageway and out onto brush bristles through a number of toothpaste dispensing openings formed through the exterior of the hollow brush head and positioned adjacent to bristle bottoms of the brush bristles;

the hollow brush head further including a flip open back cap that is in connection with the brush head toothpaste passageway and which is moveable into an open position to allow for cleaning of the brush head toothpaste passageway between uses.

* * * * *